US007784536B2

(12) United States Patent
Scoggins et al.

(10) Patent No.: US 7,784,536 B2
(45) Date of Patent: Aug. 31, 2010

(54) PACKER INSERT FOR SEALING ON MULTIPLE ITEMS USED IN A WELLBORE

(75) Inventors: John P. Scoggins, Katy, TX (US); William L. Carbaugh, Humble, TX (US)

(73) Assignee: Hydril USA Manufacturing LLC, Houston, TX (US)

( * ) Notice: Subject to any disclaimer, the term of this patent is extended or adjusted under 35 U.S.C. 154(b) by 0 days.

(21) Appl. No.: 12/553,761

(22) Filed: Sep. 3, 2009

(65) Prior Publication Data

US 2009/0321066 A1 Dec. 31, 2009

(51) Int. Cl.
*E21B 33/047* (2006.01)

(52) U.S. Cl. ..... 166/85.4; 166/84.5; 166/313

(58) Field of Classification Search ..... 166/84.5, 166/85.4, 89.2, 313
See application file for complete search history.

(56) References Cited

U.S. PATENT DOCUMENTS

| | | | |
|---|---|---|---|
| 2,187,840 | A | 1/1940 | Penick |
| 3,207,221 | A | 9/1965 | Cochran et al. |
| 3,451,481 | A | 6/1969 | Lanmon |
| 3,739,846 | A | 6/1973 | Beson |
| 3,806,168 | A | 4/1974 | McGee et al. |
| 4,060,249 | A | 11/1977 | Stowe et al. |
| 5,273,108 | A | 12/1993 | Piper |
| 5,390,966 | A | 2/1995 | Cox et al. |
| 5,775,420 | A | 7/1998 | Mitchell et al. |
| 6,015,009 | A | 1/2000 | Allen |
| 6,352,120 | B1 | 3/2002 | Carbaugh |
| 6,516,881 | B2 | 2/2003 | Hailey |
| 6,588,506 | B2 | 7/2003 | Jones |

*Primary Examiner*—Shane Bomar
(74) *Attorney, Agent, or Firm*—Potomac Patent Group PLLC

(57) ABSTRACT

A packer insert for sealing multiple items used in a wellbore includes an elastomeric member having one or more channels configured to seal on the multiple items when compressed by a packing unit, wherein the elastomeric member is made of a material selected from rubber, an elastomer, and a composite material, and wherein the packer insert is not affixed to a pressure control apparatus having the packing unit disposed therein. The packer insert is axially fixed to at least one of the multiple items.

20 Claims, 7 Drawing Sheets

PACKER INSERT FOR SEALING ON MULTIPLE ITEMS USED IN A WELLBORE

CROSS-REFERENCE TO RELATED APPLICATIONS

This application claims priority and benefit from U.S. patent application Ser. No. 11/157,120, filed Jun. 20, 2005, which issued on Sep. 15, 2009 as U.S. Pat. No. 7,558,075, the entire contents of which are incorporated herein by reference.

STATEMENT REGARDING FEDERALLY SPONSORED RESEARCH OR DEVELOPMENT

Not applicable.

BACKGROUND OF INVENTION

1. Field of the Invention

This invention relates to devices and methods for sealing on multiple items used in a wellbore, e.g., drillpipe with umbilical and/or control lines.

2. Background Art

During drilling, completion, and production of an oil or gas well, multiple lines, such as a drill pipe, umbilical lines, and control lines, may be run in the well. There are occasions when the well needs to be sealed off or a section of the well needs to be isolated from other sections. For example, when a well penetrates a high pressure zone, the formation fluids and gas may rush into the wellbore. When this happens, the well is said to have taken a "kick." The high pressure gas will quickly rise in the wellbore and expands its volume many times in the process. If this gas is allowed to reach the surface, it will blow out of the wellbore with enormous force, resulting in damages to the well equipment and injuries to the personnel. When a kick is detected, the well needs to be shut in right away, using a blowout preventer ("BOP") so that the gas can be circulated out of the wellbore in a controlled manner. In order to successfully kill a kick, it is necessary that the well can be effectively sealed.

Conventionally, when sealing on multiple lines in a wellbore is required, an annular BOP is closed around these items. However, leakage often occurs at the interface (gaps) between the BOP and the various lines. The leakage could be dangerous because it creates a hazard to both workers and the environment. As noted above, wells are typically "shut in" to prevent a blowout after a gas "kick" is detected in the wellbore. The kick is controlled by sealing the annulus of the wellbore and "circulating out" the gas in a controlled process. If gaps exist between multiple items in the wellbore, the pressure integrity of the closed in well could be lost or reduced. In this case, the well control scheme is less effective and fluid that escapes the wellbore under pressure could produce a hazard to workers.

In addition, the leakage of wellbore fluids between multiple items can also lead to environmental contamination. Oilfield service and exploration companies take great precautions to prevent drilling fluid or "mud" from escaping the fluid circulation system at the rig site. Leakage of drilling mud can contaminate the ground around the BOP stack and, as previously mentioned, can contaminate the rig floor. This is a particular problem when oil-based or potentially corrosive muds are used in the drilling process.

Subsea operations present another difficulty. Environmental regulations prevent the uncontrolled release of drilling fluids into the surrounding subsea environment. The penalties for violating these measures are severe and costly cleanups may ensue. In addition, in offshore operations, the platform may move or twist with waves or winds, making it even more difficult to have a good seal on multiple lines in a riser or wellbore.

Elastomer sleeves have been used around items in the wellbore such as umbilical or control lines in an attempt to reduce the above problems. These sleeves were typically attached only to auxiliary lines. A drawback with such a method is that locating sleeves in the BOP, diverter, or similar oil field service product is difficult. The nature of BOP operation typically requires immediate action. Therefore, the sleeves would have to be aligned with the BOP at all times so that they would be in place for activation of the BOP.

U.S. Pat. No. 6,352,120 issued to Carbaugh discloses a multiple item sealing packing insert for use with oil filed service products in a wellbore. This patent is assigned to the assignee of the present invention and is incorporated by reference in its entirety. FIG. 1 shows a cross sectional view of a packing insert disclosed in this patent. As shown, the packing insert 11, which includes a top plate 50 attached to an elastomer body 52, is disposed within a diverter 13. As in a standard diverter, the diverter 13 has a housing cap 18, a piston 20, and a sleeve 22. The packing insert 111 is positioned in the diverter 13 by attaching its top plate 50 to the diverter housing cap 18 so that the packing insert 11 will always be available. Packing unit 24 in the diverter 13, when activated, radially compresses elastomer body 52 of packing insert 11. The elastomer body 52 in turn compresses the multiple items within the wellbore to form a tight seal.

While the above described approach can provide good seals on multiple items in a wellbore, there is still a need for further devices and methods that can provide good seals on multiple items in a wellbore.

SUMMARY OF INVENTION

One aspect of the invention relate to packer inserts for sealing multiple items. A packer insert in accordance with one embodiment of the invention includes an elastomeric member having one or more channels configured to seal on the multiple items used in a wellbore when compressed by a packing unit, wherein the elastomeric member is made of a material selected from rubber, an elastomer, and a composite material, and wherein the packer insert is not affixed to a pressure control apparatus having the packing unit disposed therein. The packer insert is axially fixed relative to at least one of the multiple items.

Another aspect of the invention relates to packer inserts for sealing multiple items used in a wellbore. A packer insert in accordance with one embodiment of the invention includes an inner member having a plurality of channels formed therein. The inner member comprises at least two linked sections and each of the plurality of channels has a diameter selected for one of the multiple items. A shell made of a harder material than the inner member is configured to hold the at least two linked sections together around the multiple items. A guide end is disposed on an end of the packer insert. The packer insert forms a seal on each the multiple items when the shell is radially compressed by a packing unit. The packer insert is not affixed to a pressure control apparatus having the packing unit disposed therein.

Another aspect of the present invention is a method of sealing in a subsea blowout preventer. The method includes deploying at least one item in a wellbore. Packer inserts are placed at a plurality of axial locations on the at least one item deployed in a wellbore. The method includes raising or lowering the at least one item in a wellbore to position one of the plurality of packer inserts within the subsea blowout preventer and sealing off the subsea blowout preventer with the one of the plurality of packer inserts.

Other aspects and advantages of the invention will be apparent from the following description and the appended claims.

DETAILED DESCRIPTION

Embodiments of the invention relate to packer inserts and methods for sealing on multiple items in a wellbore, such as a drill pipe, umbilical and control lines. Note that while these packer inserts are used to form seals on multiple items in the wellbore, these packer inserts are typically assembled on the multiple items before the multiple items are run into the wellbore. A packer insert in accordance with embodiments of the invention may provide seals around multiple items while allowing the multiple items to have some degree of freedom (e.g., slight twisting or movement in the wellbore).

Figure 1:
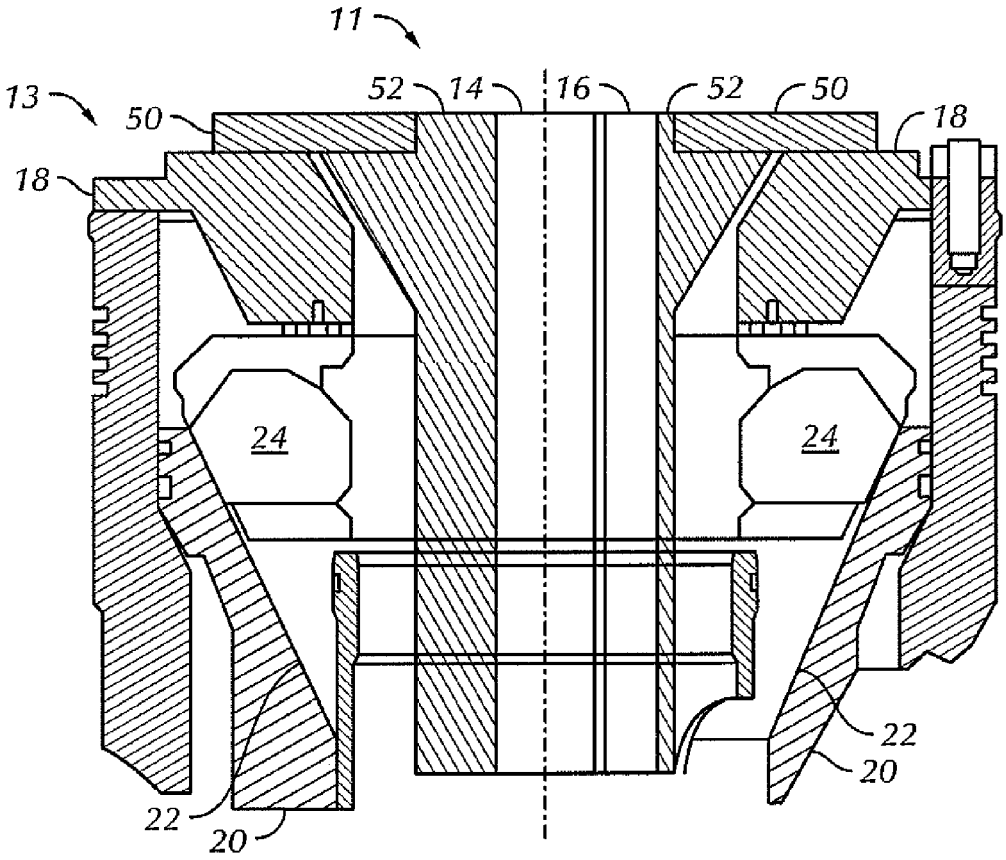
FIG. 1 (Prior Art)
FIG. 1 shows a prior art packing insert affixed to a diverter.

Packer inserts can improve seals between a pressure control apparatus (e.g., BOP, diverter, or packer) and multiple items in a wellbore. For example, FIG. 1 shows a cross sectional view of a packing insert disclosed in U.S. Pat. No. 6,352,120 issued to Carbaugh. The packing inserts disclosed in this patent are designed to be fixed to a pressure control apparatus, e.g., a diverter. They cannot provide sealing at any axial location in the wellbore. Furthermore, they are not designed to withstand possible twisting or movement of the multiple lines in the wellbore that is often encountered in offshore drilling operations.

Embodiments of the invention, on the other hand, can provide sealing of multiple items used in a wellbore. A packer insert in accordance with embodiments of the invention may be used at any axial location of the wellbore, and, therefore, it can be used with various pressure control apparatuses, both on the surface and in the wellbore. In addition, a packer insert in accordance with embodiments of the invention can better accommodate motions (e.g., twisting) of the multiple items in the wellbore. Twisting of multiple items in the wellbore may occur in subsea applications (e.g. a BOP positioned on the seafloor) as the surface platform or ship moves relative to the wellbore.

Figure 2:
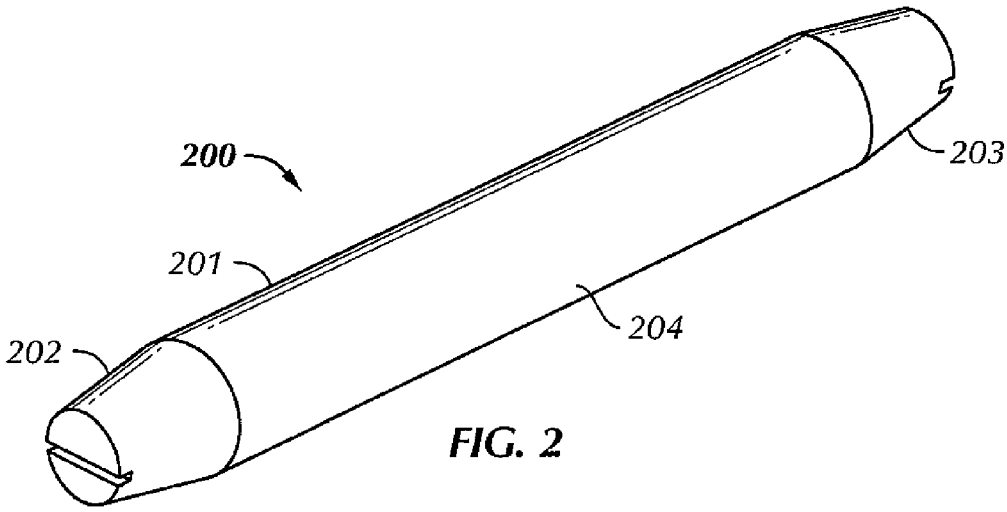
FIG. 2 shows a packer insert assembly in accordance with one embodiment of the invention.

FIG. 2 shows a packer insert assembly 200 in accordance with one embodiment of the invention. The packer insert assembly 200 includes a packer insert 201. The packer insert 201 may comprise two or more pieces to facilitate assembly on the multiple items that are to be deployed in the wellbore. The two or more pieces that form the packer insert 201 may be held together by any fastening mechanism, such as bolts 204 shown in the embodiment of FIG. 2. The various modifications of the packer insert 201 will be described in detail in a later section. In this embodiment, the packer insert assembly 200 further includes two tapered guide ends 202, 203 attached to the ends of the packer insert 201. The tapered guide ends 202, 203 serve to guide the packer insert 201 into the pressure control apparatus or other devices used in the wellbore. One of ordinary skill in the art would appreciate that a packer insert assembly in accordance with some embodiments of the invention may not include either or both pieces of the tapered guide ends.

Figure 3:
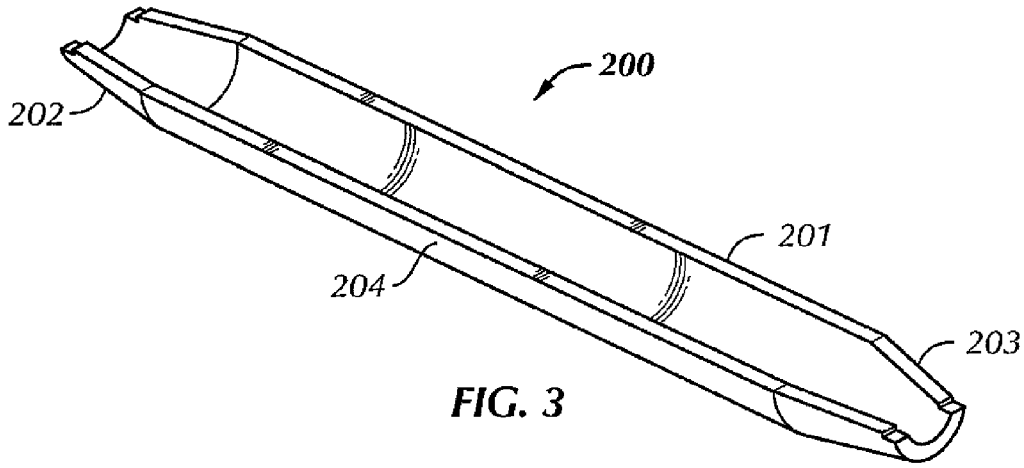
FIG. 3 shows a cross sectional view of the packer insert assembly of FIG. 2.

FIG. 3 shows a sectional view of the packer insert assembly of FIG. 2. In FIG. 3, a section of the packer insert 201 is removed to show the interior structure of the packer insert 201. As shown, the packer insert 201 may have a housing (shell) 201*a* that is designed to hold an inner member (shown as 201*b* in FIG. 4), which may be made of rubber, elastomer, or composite materials. The inner member 201*b* preferably has elastomeric properties so that it can form good seals on the multiple items. For simplicity, the inner member 201*b* may be referred to as an "elastomeric member" in this description, regardless of the material. While a substantially cylindrical shell is shown, the shape of the housing is not intended to limit the scope of the invention. The shell 201*a* may be made of any material that can transduce pressure applied from outside into the inner member. Suitable material for the shell 201*a* may include metal, plastic, rubber, or composite materials, for example.

Figure 4:
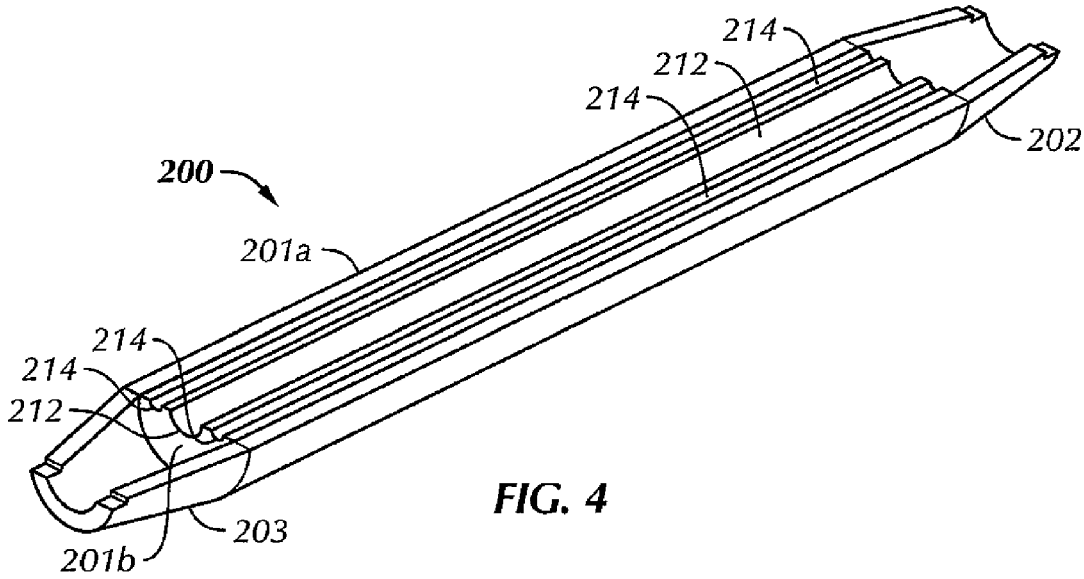
FIG. 4 shows another cross section view of the packer insert assembly of FIG. 2.

FIG. 4 shows another sectional view of the packer insert assembly of FIG. 2. In this view, an inner member (or elastomeric member) 201*b* is shown to be held inside the shell 201*a*. As shown, the inner member 201*b* includes channels for drill pipe 212 and/or other lines 214. One of ordinary skill in the art would appreciate that number and the diameters of these channels may be selected for a particular application. Thus, the number and dimensions of the channels shown in this embodiment are for illustration only and are not intended to limit the scope of the invention. Although the above examples show that the shell 201*a* and the elastomeric member 201*b* are separate components, some embodiments of the invention may have a unitary construction, in which the shell and the elastomeric member are made of the same material in a single piece. In this case, the "shell" is more appropriately referred to as the "outside surface."

As noted above, a packer insert in accordance with embodiments of the invention (e.g., 201 in FIG. 2) may comprise two or more pieces that are adapted to be assembled on the multiple items used in the wellbore. These pieces may be assembled using any attachment mechanism known in the art to attach the packer insert on the multiple items. Suitable mechanisms for attaching the packer insert to the multiple items may include, for example, hinges, bolts, and clamps. Thus, embodiments of the invention, for example, may have: (1) hinges on one side and bolts on the other; (2) bolts on both sides; and (3) clamps, for assembling the packer inserts on the multiple items. When attached to the multiple items, the friction between the inner member (201*b* in FIG. 4) and the multiple items will hold the packer insert in place. Alternatively, other mechanisms (e.g., clamps) may be used to secure the packer inserts on the multiple items. In one embodiment, the packer insert may be axially fixed to only one of the multiple items such that others of the multiple items are able to move independently in the axial direction relative to the packer insert. This may be accomplished, for example, by having a tighter fit between one of the channels and the one of the multiple items to which the packer insert is axially fixed.

Figure 6A:
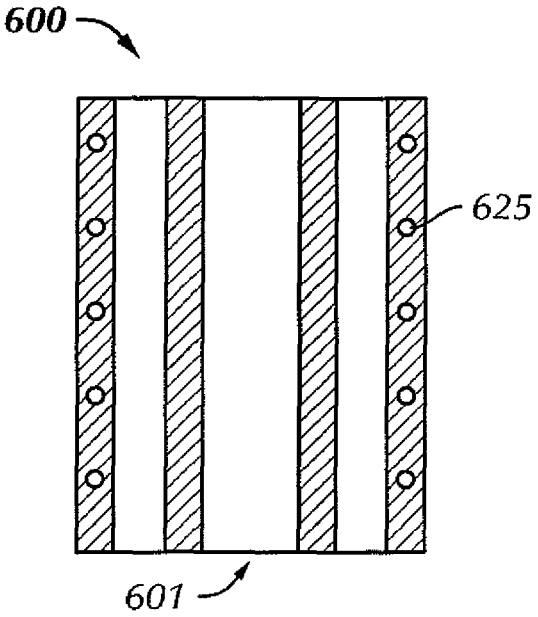
FIG. 6A shows a packer insert in accordance with another embodiment of the invention in an open configuration.
Figure 6B:
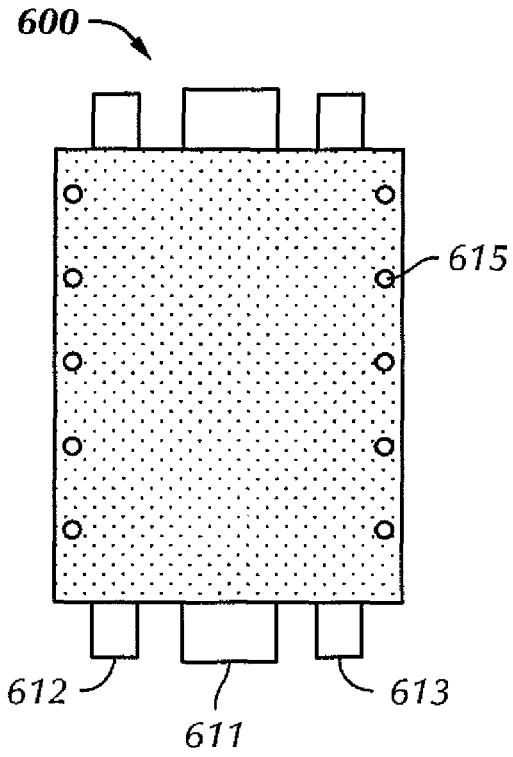
FIG. 6B shows the packer insert of FIG. 6A assembled on multiple items used in a wellbore.
Figure 7:
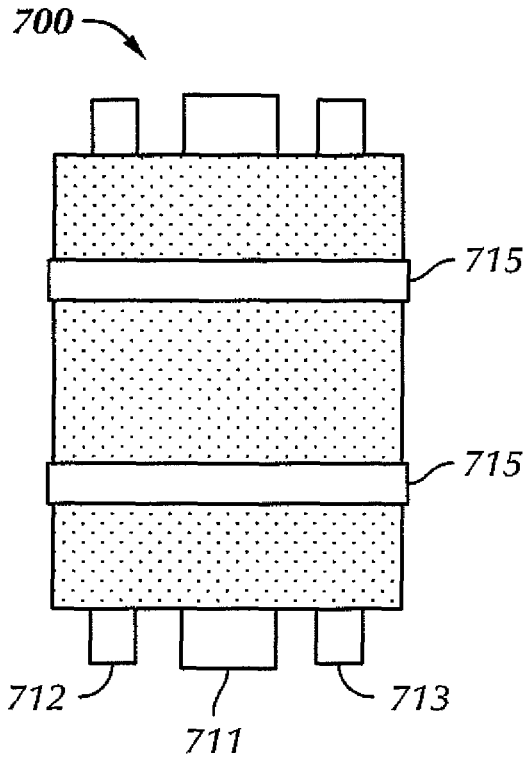
FIG. 7 shows a packer insert in accordance with another embodiment of the invention assembled on multiple items used in a wellbore.

FIGS. 5-7 illustrate some packer inserts that can be used to seal on multiple items used in a wellbore, in accordance with some embodiments of the invention. One of ordinary skill in the art would appreciate that these examples are for illustration only and are not intended to limit the scope of the invention.

Figure 5A:
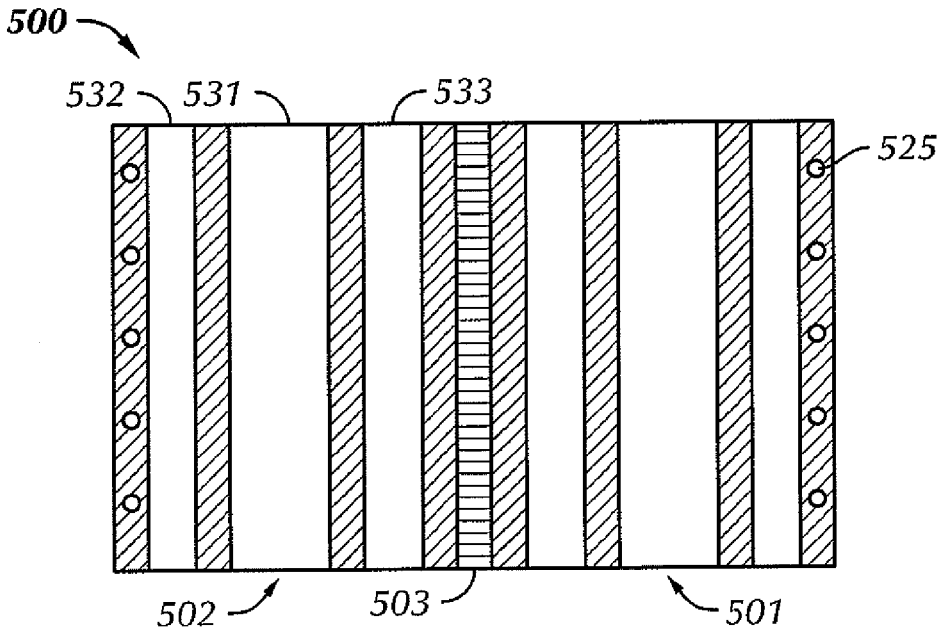
FIG. 5A shows a packer insert in accordance with one embodiment of the invention in an open configuration.
Figure 5B:
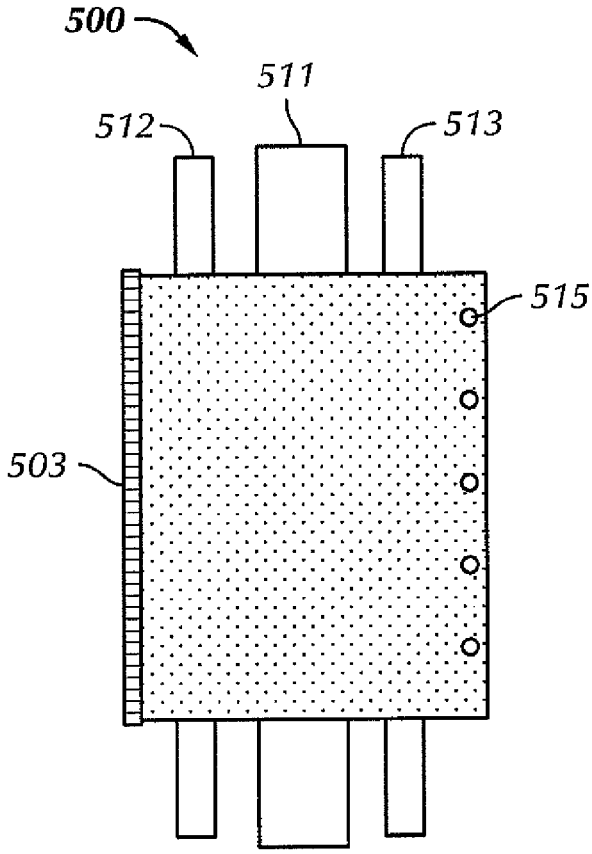
FIG. 5B shows the packer insert of FIG. 5A assembled on multiple items used in a wellbore.

FIGS. 5A and 5B show a packer insert in accordance with one embodiment of the invention. As shown in FIG. 5A, a packer insert 500 comprises two halves 501 and 502, which are linked by a hinge 503, in an open position. The two halves 501 and 502 may be attached to multiple items (e.g., a drill pipe 511 and two auxiliary lines 512, 513) by means of bolts 515, as shown in FIG. 5B. Note that the two "halves" in this particular example need not be of the same or similar sizes. The reference to two halves in this particular example is for illustration only. One of ordinary skill in the art would appreciate that embodiments of the invention may comprise one piece, two pieces, or more than two pieces.

Referring again to FIG. 5A, the inside of the packer insert 500 have channels (e.g., 531, 532, and 533) that are configured to accommodate the various lines (e.g., drill pipe 511, and auxiliary/control lines 512, 513 shown in FIG. 5B) to be encountered in the wellbore. The number and diameters of these channels are designed to fit the multiple items for the particular application. In accordance with some embodiments of the invention, it may not be necessary to provide a channel on the elastomeric member if the line to be sealed has a small diameter. In this case, compression of the elastomeric member onto the line will be sufficient to form a seal around the line. As shown in this embodiment, the two halves 501 and 502 are linked by a hinge 503 on one side. This linkage may be a permanent linkage or a temporary linkage (i.e., can be disengaged). On the other sides of the two halves 501, 502 of the packer insert 500, bolt holes 525 are provided so that bolts (shown as 515 in FIG. 5B) may be used to assemble the two halves 501, 502 on multiple items in the wellbore. When assembled on the multiple items, as shown in FIG. 5B, interference between the inner member of the packer insert and the multiple lines (e.g., the drill pipe, umbilical and control lines) will effect a seal and hold the packer insert in place on the multiple items.

Although the packer insert is preferably made of two halves, as shown in FIGS. 5A and 5B, other modifications of this configuration are possible. For example, the two halves 501 and 502 may be an integral part (a unitary construction) (i.e., no hinge is needed), if the material comprising the packer insert is pliable. In this case, the packer insert 500 is separable on the side where the bolt holes 525 are. The one-piece packer insert may be plied open to fit on the multiple items before it is fixed with the bolts, for example. Alternatively, the packer insert may comprise more than two pieces.

FIGS. 6A and 6B show a packer insert in accordance with another embodiment of the invention. As shown in FIG. 6A, the packer insert 600 comprises two identical halves (only one half 601 is shown). Each of the packer insert half 601 has holes 625 on both sides for assembly on multiple items 611, 612, 613 using bolts 615, as shown in FIG. 6B.

In addition to hinges and bolts, other mechanisms may also be used to attach the packer insert on multiple items. FIG. 7 shows a packer insert 700 in accordance with one embodiment of the invention, in which clamps 715 are used for the attachment. Note that while two clamps 715 are shown in this example, the number and locations of the clamps used are not intended to limit the scope of the invention. The packer insert 700 may comprise two halves that are linked by a hinge (see e.g., FIG. 5A) or any other mechanism. The two halves may also be separate pieces not linked together (see e.g., FIG. 6A). Furthermore, the packer insert 700 may comprise one piece (as discussed above with reference to FIG. 5A for a unitary construction) or more than two pieces.

In accordance with some embodiments of the invention, a packer insert assembly may include guide ends at one or both ends of the packer insert for additional placement retention (see e.g., FIG. 2). The packer inserts described above can be used with or without guide ends in a packer insert assembly. In embodiments with guide ends, the guide ends may hold the packer insert in place on the multiple items in a wellbore.

Figure 8A:
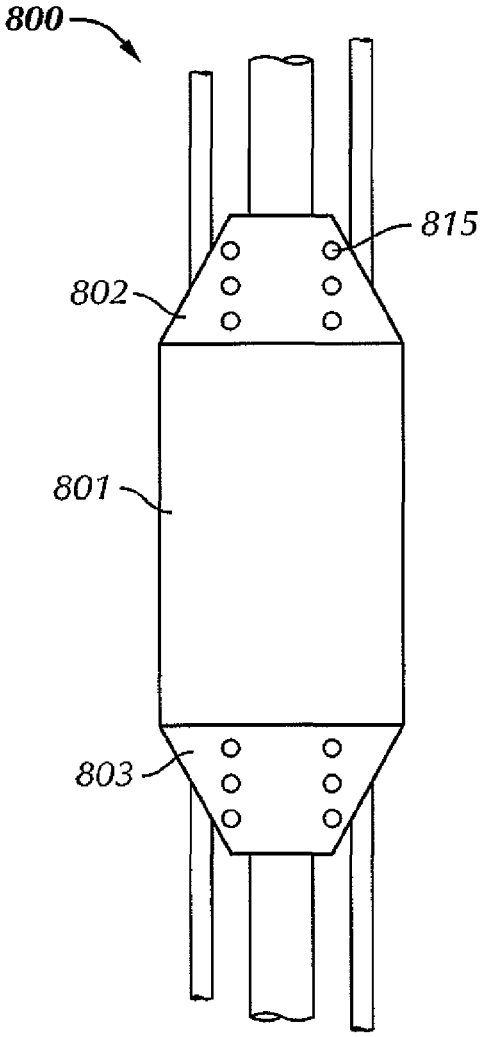
FIG. 8A shows a packer insert assembly attached to multiple items in accordance with one embodiment of the invention.
Figure 8B:
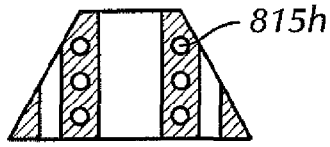
FIG. 8B shows a guide end in accordance with one embodiment of the invention.

FIGS. 8A and 8B show a packer insert assembly in accordance with one embodiment of the invention. As shown in FIG. 8A, a packer insert assembly 800 includes two guide ends 802 and 803 that help to secure the packer insert 801 in place. The guide ends 802, 803 may be attached to the multiple items in the wellbore using any mechanisms known in the art, including hinges, bolts and clamps. FIG. 8B shows one embodiment of a guide end that includes bolt holes 815*h* so that the guide ends 802, 803 may be secured on the multiple items using bolts 815 (FIG. 8A).

Figure 8C:
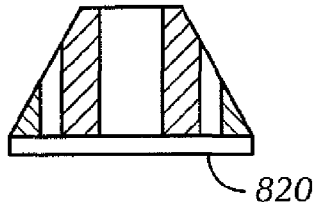
FIG. 8C shows a guide end in accordance with another embodiment of the invention.

In accordance with some embodiments of the invention, the guide ends may have overhanging flanges that are designed to circumscribe the packer insert. One such example is shown in FIG. 8C, in which the guide end includes a flange 820 that is sized to fit over the circumference of a packer insert. Note that in accordance with some embodiments of the invention, the axial extension of the flange 820 may be selected to cover a substantial portion of the packer insert such that the compression force provided by the flange 820 may be sufficient to hold the packer insert in place. With such an embodiment, the packer insert may not need any fastening mechanism (e.g., a hinge, bolt, or clamp) to hold it in place on the multiple items.

Packer inserts in accordance with embodiments of the invention can form tight seals on multiple items and may be placed anywhere in a wellbore. Therefore, these packer inserts may be used with a BOP, a diverter, or other pressure control apparatuses. In addition, being able to from tight seals around pipes or other items in the wellbore makes these packer inserts suitable for use in radially joining strings of pipes and tubing in a wellbore.

In a method in accordance with one embodiment of the present invention, a BOP may be positioned on a seafloor. While lowering multiple items into a wellbore, a packer insert may be attached to one of the multiple items at intermittent axial locations. In the event that it is desired to seal off the wellbore, the packer insert closest to the BOP may be raised or lowered into position inside the BOP by raising or lowering the item to which the packer insert is attached. Deploying multiple packer inserts allows for increased sealing safety in the event that a BOP on the seafloor must be sealed off in an emergency to avoid a potential blowout.

Figure 9:
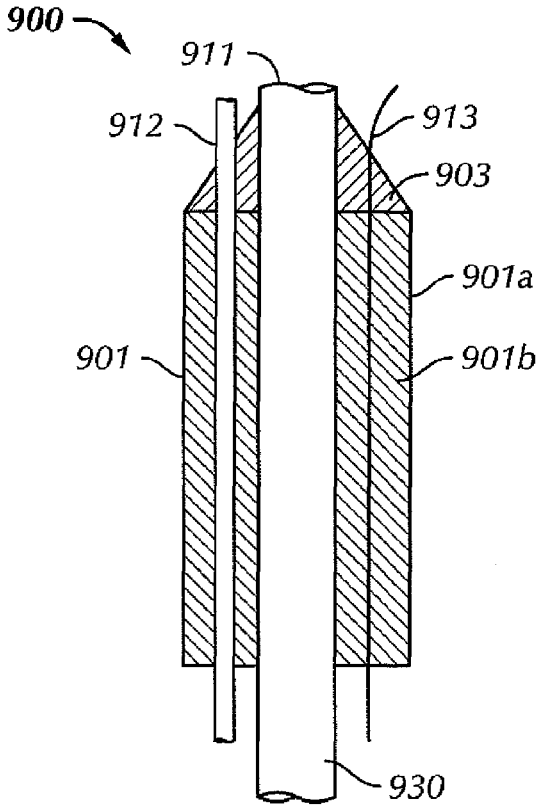
FIG. 9 shows a packer insert in accordance with one embodiment of the invention used on a pup joint.

FIG. 9 illustrates a cross sectional view of a packer insert of the invention used in joining a pup joint in a wellbore. As shown, a packer insert 901 is secured around and seals a pup joint 911, an auxiliary line 912, and an umbilical line 913. The packer insert 901 is held in place by clamps or guide end 903. The pup joint 911 includes standard threads for connection with other drill pipe section 930. To secure the pup joint 911, the packer insert 901 preferably has a shell (or housing) 901*a* that can provide mechanical support. For example, the shell 901*a* may be made of metal, plastic, or a composite material. The inner member 901*b* of the packer insert 901 preferably comprises rubber or an elastomer material so that it can form a seal around the multiple items in the wellbore.

Figure 10:
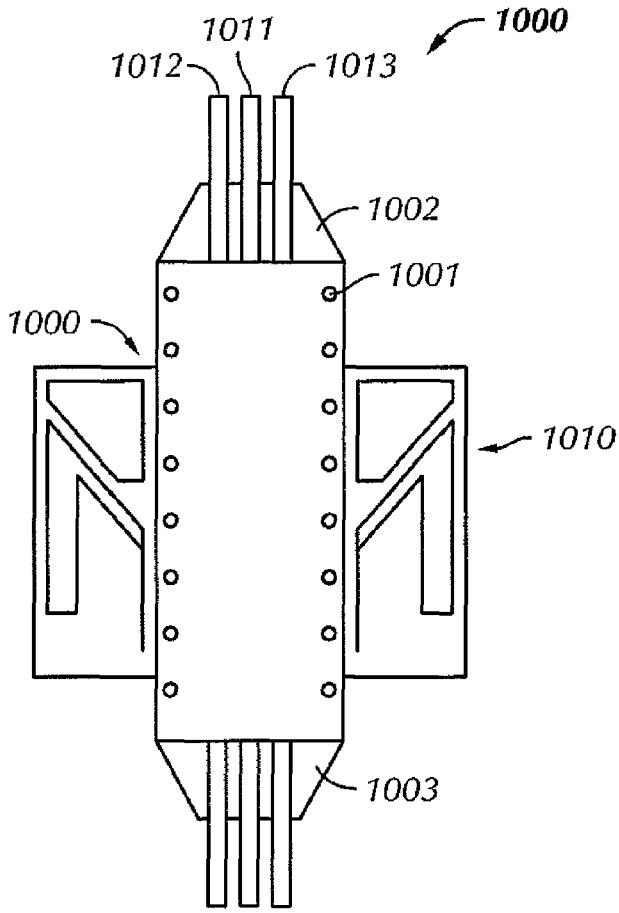
FIG. 10 shows a packer insert assembly used with a diverter.

As noted above, a packer insert in accordance with embodiments of the invention may be used with various pressure control apparatuses, such as a BOP or a diverter. For example, FIG. 10 shows a packer insert assembly 1000 of the invention disposed in a diverter 1010. The packer insert assembly 1000 seals on a drill pipe 1011, an umbilical line 1012, and a control line 1013. The packer insert assembly 1000 includes two guide ends 1002, 1003 and a packer insert 1001. Note that the packer insert assembly 1000 is not fixed on the diverter 1010. Therefore, the packer insert assembly 1000 may maintain a tight seal on the multiple items even when the multiple items have dynamic movements (e.g., twisting or lateral movement) relative to the diverter 1010.

Figure 11A:
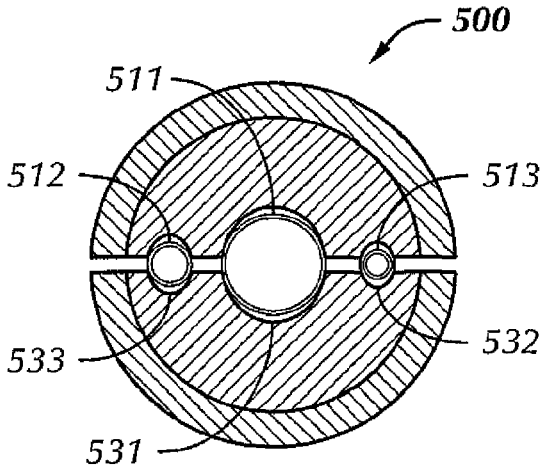
FIG. 11A shows a top view of a packer insert in accordance with one embodiment of the invention.
Figure 11B:
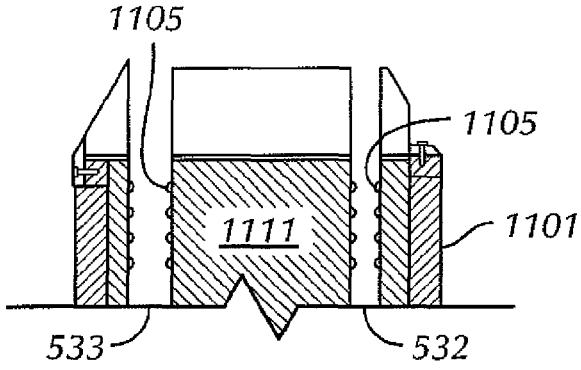
FIG. 11B shows a partial cross section side view of a reinforced packer insert in accordance with one embodiment of the invention.
Figure 11C:
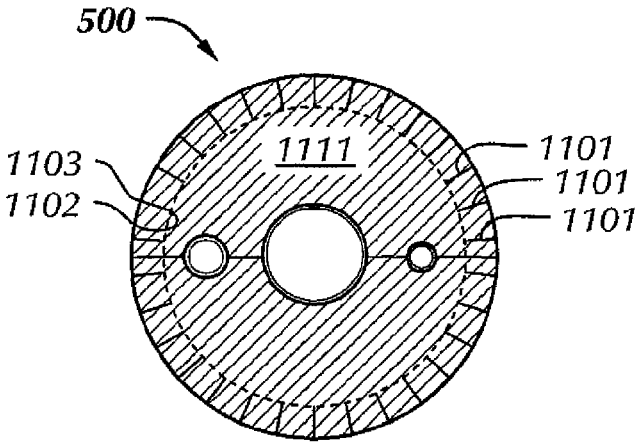
FIG. 11C shows a cross section of a top view of the reinforced packer insert shown in FIG. 11B.

In some applications, the pressure that must be sealed may be too great for a packer insert made entirely of an elastomeric material. FIGS. 11A-C show a packer insert for higher pressure applications in accordance with an embodiment of the present invention is shown. To increase the strength of the packer insert 500, supports 1101, as shown in FIGS. 11B and 11C, may be integrally molded with the elastomeric member 1111. The supports 1101 may be made of a rigid material, such as steel, aluminum, or carbon fiber composite. Asymmetric I-beams are a preferable shape for the supports 1101, as shown in FIG. 11C. The inner web 1102 may be narrower than the outer web 1103. The width of the inner web 1102 and the outer web 1103 may be selected such that there is clearance between adjacent supports 1101 when the packer insert 500 is compressed to seal around the multiple items. The width of the outer web 1103 may be selected such that there is little clearance between the supports 1101 on the outer circumference of the packer insert 500. This causes the outer webs 1103 to act as a rigid shell when the packer insert 500 is compressed.

Channels (e.g. 531, 532, 533) may include sealing ridges 1105 formed therein. When compressed, the cylindrical inner surface of the channels may ripple or otherwise deform into a non-cylindrical shape, which can provide a leak path for pressure. Sealing ridges 1105 may be formed to act as individual sealing elements, such as O-rings. Multiple sealing ridges 1105 may be integrally molded in the elastomeric member 1111. For example, to integrally mold the sealing ridges 1105 shown in FIG. 11B, semi-circular grooves may be formed in the mold such that the negative has the shape of an O-ring. Those having ordinary skill in the art will appreciate that many alternate shapes may be used for sealing ridges 1105 without departing from the scope of the present invention.

Some embodiments of the invention may form tight seals around one or more of the multiple items when assembled. Other embodiments of the invention may loosely circumscribe the multiple items and held in place by interference (friction) or clamps. With such embodiments, tight seals on the multiple items are effected by inflating one or more packers in a wellbore. The inflated packers compress on the outside surface (or the shell) of the packer insert to form tight seals between the packers and the packer inserts. At the same time, the compression force also pushes the packer inserts on the multiple items to form tight seals between the packer inserts and the multiple items.

Embodiments of the invention may have one or more of the following advantages. A packer insert in accordance with embodiments of the invention may be used to protect and seal around multiple items, such as a drill pipe, umbilical lines, and auxiliary lines, running through a packing unit disposed in a pressure control apparatus. Being able to seal around multiple items is important for protecting things running through a packing unit, especially in offshore operations. The packer insert may also hold the umbilical and/or hydraulic lines so that they will not stretch and get damaged. This can also prevent ship movement (e.g., twist or rotate due to wind or waves) from damaging the cables/umbilicals running through the packing unit.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

The invention claimed is:

1. A packer insert for sealing multiple items, the packer insert comprising:

a shell extending along a longitudinal axis and having two or more parts configured to connect to each other, each part extending along the longitudinal axis; and an elastomeric member provided inside the shell and having one or more channels configured to receive the multiple items used in a wellbore when compressed by a packing unit, wherein the shell and the elastomeric member are configured to be pressed towards the multiple items when the packing unit compresses the shell such that the elastomeric member seals a space above the packer insert from a space below the packer insert to prevent a fluid in the wellbore traveling along and outside the multiple items past a contact region between the packer insert and the multiple items and also between the packer insert and the packing unit, and wherein the packer insert is configured to axially reciprocate within the packing unit when the packing unit is in a close position.

2. The packer insert of claim 1, wherein the packer insert is axially fixed relative to at least one of the multiple items.

3. The packer insert of claim 1, wherein the elastomeric member is made of a material selected from rubber, an elastomer, and a composite material.

4. The packer insert of claim 1, wherein the packer insert is not affixed to a pressure control apparatus having the packing unit disposed therein.

5. The packer insert of claim 1, wherein the packer insert is configured to allow one or more of the multiple items to move relative to the shell when the packing unit is closed.

6. The packer insert of claim 5, wherein the move includes twisting.

7. The packer insert of claim 5, wherein the move includes axial movement.

8. The packer insert of claim 1, wherein the packing unit is part of a blowout preventer or a diverter.

9. The packer insert of claim 1, further comprising:

other packer inserts attached to the multiple items above or below the packer insert.

10. A packer insert for sealing multiple items within a riser or a well, the packer insert comprising:

a shell extending along a longitudinal axis and having two or more parts configured to connect to each other, each part extending along the longitudinal axis; and an elastomeric member provided inside the shell and having one or more channels configured to receive the multiple items used in a wellbore when compressed by a packing unit, wherein the shell and the elastomeric member are configured to be pressed towards the multiple items when the packing unit compresses the shell such that the elastomeric member seals a space between the multiple items to prevent a fluid from traveling along the riser or the well past an interface between the packer insert and the packing unit and an interface between the packer insert and the multiple items, and wherein the packer insert is configured to axially reciprocate within the packing unit when the packing unit is in a close position.

11. The packer insert of claim 10, wherein the packer insert is axially fixed relative to at least one of the multiple items.

12. The packer insert of claim 10, wherein the elastomeric member is made of a material selected from rubber, an elastomer, and a composite material.

13. The packer insert of claim 10, wherein the packer insert is not affixed to a pressure control apparatus having the packing unit disposed therein.

14. The packer insert of claim 10, wherein the packer insert allows one or more of the multiple items to move relative to the shell when the packing unit is closed.

15. The packer insert of claim 14, wherein the move includes twisting.

16. The packer insert of claim 14, wherein the move includes axial movement.

17. The packer insert of claim 10, wherein the packing unit is part of a blowout preventer or a diverter.

18. The packer insert of claim 10, further comprising:

other packer inserts attached to the multiple items above or below the packer insert.

19. Multiple items connected by a packer insert configured as recited by claim 1.

20. Multiple items connected by a packer insert configured as recited by claim 10.

* * * * *